US008062498B2

(12) United States Patent
Palmu

(10) Patent No.: US 8,062,498 B2
(45) Date of Patent: Nov. 22, 2011

(54) METHOD OF MANUFACTURING A CATHODE PLATE, AND A CATHODE PLATE

(75) Inventor: Lauri Palmu, Helsinki (FI)

(73) Assignee: Outotec Oyj, Espoo (FI)

( * ) Notice: Subject to any disclaimer, the term of this patent is extended or adjusted under 35 U.S.C. 154(b) by 308 days.

(21) Appl. No.: 12/526,660

(22) PCT Filed: Feb. 13, 2008

(86) PCT No.: PCT/FI2008/050055

§ 371 (c)(1),
(2), (4) Date: Aug. 11, 2009

(87) PCT Pub. No.: WO2008/099057

PCT Pub. Date: Aug. 21, 2008

(65) Prior Publication Data

US 2010/0078319 A1 Apr. 1, 2010

(30) Foreign Application Priority Data

Feb. 13, 2007 (FI) ..... 20070125

(51) Int. Cl.

| | |
|---|---|
| ***C25D 3/38*** | (2006.01) |
| ***B21B 1/22*** | (2006.01) |
| ***B21B 1/28*** | (2006.01) |
| ***B22D 11/126*** | (2006.01) |

(52) U.S. Cl. ..... 205/206; 205/149; 205/152; 205/291; 205/575; 29/527.5; 29/527.6; 29/527.7; 204/281; 204/286.1

(58) Field of Classification Search ..... 29/527.5, 29/527.6, 527.7; 204/281, 286.1; 205/575, 205/149, 152, 205, 206, 291
See application file for complete search history.

(56) References Cited

U.S. PATENT DOCUMENTS

| | | | | |
|---|---|---|---|---|
| 6,153,082 | A | 11/2000 | Debord et al. | |
| 7,807,028 | B2 * | 10/2010 | Webb | 204/281 |
| 2006/0201586 | A1 * | 9/2006 | Webb | 148/325 |

FOREIGN PATENT DOCUMENTS

| | | | |
|---|---|---|---|
| GB | 2040311 | A | 8/1980 |
| WO | 2006094355 | A1 | 9/2006 |

* cited by examiner

*Primary Examiner* — Bruce Bell
(74) *Attorney, Agent, or Firm* — Chernoff, Vilhauer, McClung & Stenzel

(57) ABSTRACT

A method of manufacturing a cathode plate (1) that is used in the electrolytic cleaning and recovery of metals, the cathode plate being at least partly manufactured of stainless steel and the surface of the cathode plate being treated in at least one stage, whereby the cathode plate is formed by cutting it from a solid plate-like material (2), whereby, essentially before cutting (4) the cathode plate to shape, at least part of the surface constituting the cathode plate is subjected to a mechanical treatment (3) to improve the adhesion properties of the surface. The invention also relates to the cathode plate.

16 Claims, 1 Drawing Sheet

METHOD OF MANUFACTURING A CATHODE PLATE, AND A CATHODE PLATE

This is a national stage application filed under 35 USC 371 based on International Application No. PCT/FI2008/050055 filed Feb. 13, 2008, and claims priority under 35 USC 119 of Finnish Patent Application No. 20070125 filed Feb. 13, 2007.

The present invention relates to a method of manufacturing a cathode plate that is used in the electrolytic cleaning and/or recovery of metal, and to a cathode plate.

BACKGROUND OF THE INVENTION

In the electrolytic cleaning and recovery of metals, the surface quality of the cathode plate is important. By affecting the adhesion properties of the surface, a cathode plate of a better quality is obtained. In the electrolytic cleaning of copper, the copper that is dissolved in the electrolyte from copper anodes precipitates as pure copper, by means of an electric current, on the surface of the cathode plate, from where it is typically removed mechanically in the form of a copper plate. In the recovery of copper, copper precipitates on the cathodes directly from the electrolytic solution. The cathodes are generally called permanent cathodes, because they can be re-used subsequently. It is well-known to use stainless steal as the material of the cathode plate. Generally, acid-proof steel 316 L is used, having a surface quality of 2B, whereby the $R_a$ value describing the roughness of the surface is within a range of 0.3-0.6 μm. Typically, the surface mentioned above is obtained, when the steel plate working as the cathode is cold-rolled, annealed, etched in an acid bath, and subjected to dressing. In etching and dressing, the grain boundaries of the steel open, whereby microscopic grooves and canyons are formed on the surface of the steel plate, and the electrolytically coated metal is able to grow in and attach to these grooves and canyons. In use, however, the surface of the steel plate undergoes wear, contamination and changes, whereby the surface must be treated by brushing and grinding. In terms of process technology, manufacturing the surface of the cathode plate by etching and dressing is quite challenging, and an unacceptably short etching time can easily destroy the quality of the surface so as to become unsuitable for the electrolytic coating.

Publication FI 68430 B, for example, discloses the use of stainless steel as material for cathodes. Regarding the material, the publication describes in detail the AISI 316L steel, which has a surface treatment known as Standard 2B. The publication mentioned above states that the material in question is advantageous, as a sufficient fixing adhesion is provided between the steel plate and the copper so that the copper does not detach of its own accord before the actual releasing phase. The use of stainless steel as the material for cathodes is also disclosed in publication U.S. Pat. No. 6,485,621 B. Publication US 2006/0201586 A1 discloses a permanent cathode that is used in the electrolytic refining of metals, consisting of duplex steel containing a small content of nickel, or of steel grade "304". The publication goes on to describe that the surface of the cathode plate is treated to improve its adhesion properties. The publication presents a surface treatment for improving the adhesion properties of the cathode surface, such as a mechanical treatment, e.g. grinding, to change the hardness of the surface, and etching. Furthermore, the publication suggests that the cathode surface be slotted to improve the above-mentioned properties.

SUMMARY OF THE INVENTION

This invention relates to the method of manufacturing a cathode plate that is used in the electrolytic cleaning and recovery of metals, and to a cathode plate that is manufactured by the method. In particular, the purpose of the invention is to provide a solution to the manufacture of cathode plates, whereby the cathode plate is made by cutting it from a solid plate-like material, whereby before cutting the cathode plate to shape, at least part of the surface forming the cathode plate is subjected to a mechanical surface treatment to improve the adhesion properties of the surface.

The essential features of the invention are disclosed in the appended claims.

The invention relates to the method of manufacturing a cathode plate that is used in the electrolytic cleaning and/or recovery of metals, the cathode plate being at least partly manufactured of stainless steel, and the surface of the cathode plate being treated in at least one stage, whereby the cathode plate is formed by cutting it from a solid plate-like material, whereby essentially before the cathode plate is cut to shape, at least part of the surface constituting the cathode plate is subjected to a mechanical surface treatment to improve the adhesion properties of the surface. In the mechanical surface treatment, grooves are then formed on at least part of the surface of the cathode plate, being in a horizontal direction with respect to the direction of suspension of the cathode plate. According to an embodiment of the invention, the mechanical surface treatment is carried out with at least one surface treatment member by immersing it in the surface of the plate-like material at a right angle, while the surface moves, whereby the surface treatment member is a brush and/or a grinding apparatus, for example. By accurately directing to the surface, to a desired spot on the surface, a mechanical surface treating device, a desired roughness level of the surface is achieved, preferably improving the adhesion properties of the surface. When the grooves on the surface of the cathode plate are in a horizontal direction with respect to its direction of suspension, the vertical force of the grooves keeps the precipitated metal plate attached to the cathode, while the cathode hangs. The horizontal grooves on the surface of the cathode plate form an advantageous surface of adhesion for the metal that is precipitated on the surface at the beginning of the coating cycle, in particular. If the grooves were in a vertical direction, their adhesive power would not be as good as that of the horizontal grooves, and the cathode would most likely drop off the metal plate too early. When detaching the cathode plate, the cathode is generally bent, whereby the separating force is exerted sideward and, in that case, the horizontal grooves do not impede the detachment. In terms of manufacturing techniques, the method is advantageous, as the individual cathode plates do not need to be treated separately.

According to an embodiment of the invention, the grooves are formed so that they extend over the entire surface of the cathode plate, whereby they improve the adhesion of the precipitated metal throughout the surface. According to a preferred embodiment of the invention, in the mechanical surface treatment, the grooves are formed so that their depth in the cathode plate is preferably 5 to 10 μm, and so that the distance between adjacent grooves is preferably 10 to 30 μm. According to an embodiment of the invention, the mechanical surface treatment is carried out on both sides of the cathode plate, whereby the adhesion of the metal layer that is precipitated on both sides of the cathode plate also improves. According to the invention, the surface of the plate-like material is possibly rolled into a desired thickness before the mechanical surface treatment. According to an example of the invention, the surface of the plate-like material is subjected to dressing to straighten the plate before cutting the cathode plate. According to the invention, the cathode plate is at least partly formed of a plate-like material that comprises austenitic steel and/or ferritic-austenitic steel. By means of the surface treatment according to the invention, a cathode plate is provided, the $R_a$ value of its surface preferably being 0.3-0.6 μm, which is advantageous for the adhesion. The cathode plate manufactured by the method according to the invention is a permanent cathode, for example, i.e., it can be re-used.

BRIEF DESCRIPTION OF THE DRAWINGS

In the following, the equipment according to the invention is described with reference to the appended drawings, in which.

DETAIL DESCRIPTION OF THE INVENTION

Figure 1:
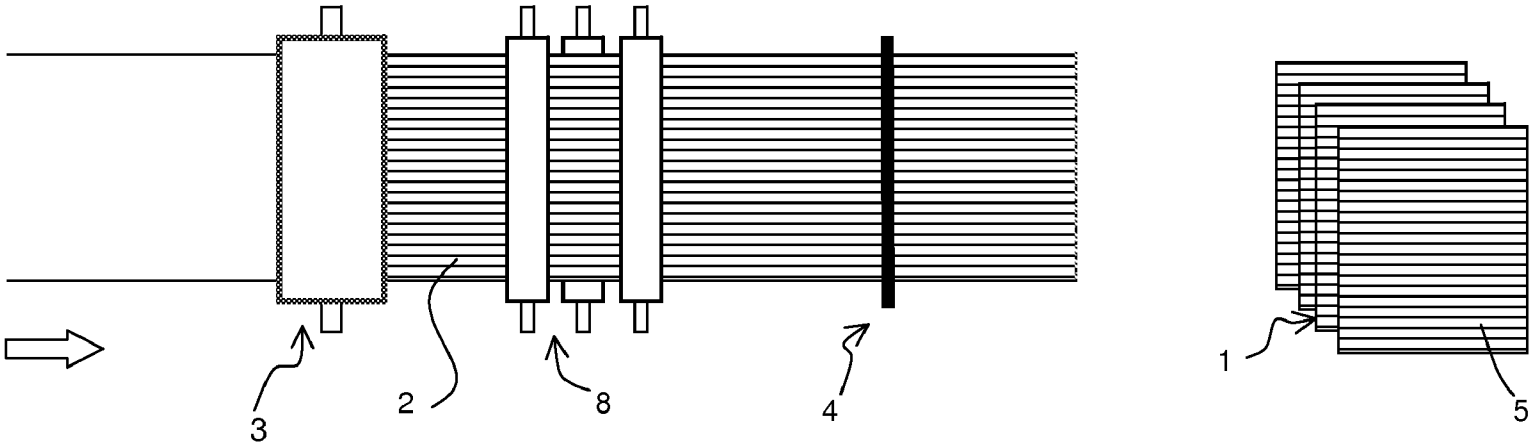
FIG. 1 is a basic figure of the manufacturing method of the cathode plate according to the invention.
Figure 2:
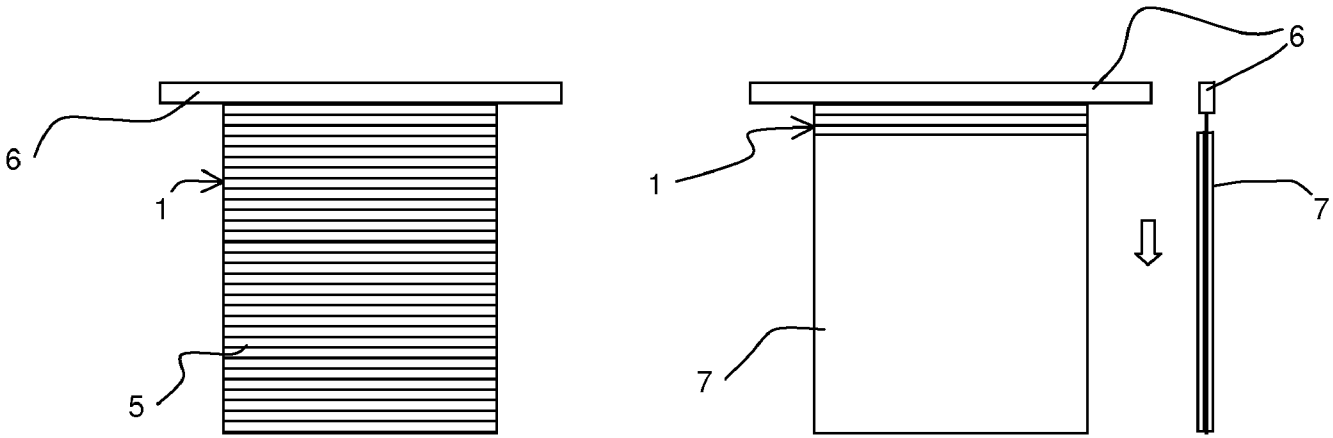
FIG. 2 is a basic figure of the finished cathode plate.

FIG. 1 shows the method according to the invention for manufacturing the electrolytic plate or cathode plate 1 that is used in the electrolytic cleaning and recovery of metals. The cathode plate is made of plate-like material 2, which is stainless steel, such as austenitic or ferritic-austenitic steel and, according to the method of the invention, the surface that forms the cathode plate is treated in at least one stage to affect the adhesion properties of the surface to improve the permanence of the metal layer that precipitates on the surface. The cathode can be used as a permanent cathode, i.e., it can be re-used subsequently. The cathode plate 1 is formed by cutting it from the solid plate-like material 2, whereby, essentially before cutting 4 the cathode plate to shape from the plate-like sheet metal, a mechanical surface treatment 3 is carried out on at least part of the surface that forms the cathode plate to improve the adhesion properties of the surface. When the roll of plate-like material 2 moves, a mechanical surface treatment member, such as a brush and/or grinding apparatus or the like, is preferably directed to its surface in a perpendicular direction so that it digs into a desired depth on the surface of the plate-like material. It is important to be able to adjust the mechanical surface treatment member to a desired height and to a desired spot on the plate-like material. In the mechanical surface treatment 3 according to the invention, grooves 5 are formed on at least part of the surface that forms the cathode plate before the stage of cutting 4 to shape the cathode plate 1 from the plate-like material, the grooves 5 being in a horizontal direction with respect to the direction of suspension of the cathode plate. The grooves are formed in the same direction as the direction of movement of the plate-like material. The direction of suspension of the cathode plate refers to the direction, in which it hangs with respect to a hanger 6 in a tank designed for electrolytic cleaning or recovery, for example.

According to the example of this invention, the grooves 5 are formed on the plate-like material 2 so as to exist on both sides of the finished cathode plate 1 so that the surface of the cathode plate is evenly slotted. According to the example, in the surface treatment of the cathode plate 1, the grooves are formed so that their depth in the cathode plate is 5-10 μm, e.g., 8 μm, and the distance between adjacent grooves is about 10-30 μm, e.g., 15 μm. The $R_a$ value of the surface that is formed on the cathode plate, which is made according to the invention, is preferably 0.3-0.6 μm, which is preferable for the adhesion. Before the mechanical surface treatment, the surface of the plate-like material is rolled to a desired thickness to correspond to the optimal thickness of the cathode plate, which hangs on the hanger 6 that is used in the electrolytic cleaning or recovery, and so that the cathode plate is mechanically strong enough to endure the stress, which is inflicted on the cathode by the detachment of the metal layer, and whereby the metal plate is easy to detach. When so needed, the finished plate-like material can be subjected to dressing 7 before the cathodes are cut 4 to shape, whereby the plate is straightened to facilitate cutting.

It is obvious to those skilled in the art that the various embodiments of the invention are not limited to the examples presented above but can vary within the scope of the appended claims.

The invention claimed is:

1. A method of manufacturing a cathode plate (1) that is used in the electrolytic cleaning and/or recovery of metals, the cathode plate being manufactured at least partly of stainless steel, and the surface of the cathode plate being treated in at least one stage, characterized in that the cathode plate is formed by cutting it from a solid plate-like material (2), whereby essentially before cutting (4) the cathode plate to shape, at least part of the surface that forms the cathode plate is subjected to mechanical surface treatment (3) to improve the adhesion properties of the surface when in the mechanical surface treatment, grooves (5) are formed on at least part of the surface of the cathode plate (1), the grooves being in a horizontal direction with respect to the direction of suspension of the cathode plate.

2. A method according to claim 1, characterized in that the mechanical surface treatment (3) is carried out with at least one surface treatment member by immersing it in the surface of the plate-like material (2) at a right angle, while the surfaces moves.

3. A method according to claim 2, characterized in that the surface treatment member is a brush and/or a grinding apparatus.

4. A method according to claim 1, characterized in that the grooves (5) are formed so as to extend over the entire surface of the cathode plate.

5. A method according to claim 1, characterized in that, in the mechanical surface treatment (3), the grooves (5) are formed so that their depth in the cathode plate (1) is 5 to 10 μm.

6. A method according to claim 1, characterized in that, in the mechanical surface treatment, the grooves (5) are formed so that the distance between adjacent grooves is 10 to 30 μm.

7. A method according to claim 1, characterized in that the mechanical surface treatment is performed on both sides of the cathode plate.

8. A method according to claim 1, characterized in that the surface of the plate-like material (2) is rolled into a desired thickness before the mechanical surface treatment.

9. A method according to claim 1, characterized in that dressing (8) is carried out on the surface of the plate-like material (2) to straighten the plate before cutting the cathode plate.

10. A method according to claim 1, characterized in that the cathode plate (1) is at least partly formed of plate-like material (2) that comprises austenitic and/or ferritic-austenitic steel.

11. A cathode plate (1) that is used in the electrolytic cleaning and/or recovery of metals, the cathode plate at least partly comprising stainless steel, and the surface of the cathode plate being treated in at least one stage, characterized in that the cathode plate is formed by cutting it from a solid plate-like material (2), whereby, before cutting the cathode plate to shape, at least part of the surface constituting the cathode plate (1) is subjected to a mechanical surface treatment (3) to improve the adhesion properties of the surface when in the mechanical surface treatment, grooves (5) are formed on at least part of the surface of the cathode plate (1), the grooves being in a horizontal direction with respect to the direction of suspension of the cathode plate.

12. A cathode plate according to claim 11, characterized in that the Ra value of the surface of the cathode plate is 0.3-0.6 μm.

13. A cathode plate according to claim 11, characterized in that the cathode plate at least partly comprises austenitic and/or ferritic-austenitic steel.

14. A cathode plate according to claim 11, characterized in that the depth of the grooves (5) in the cathode plate is 5-10 μm.

15. A cathode plate according to claim 11, characterized in that the distance between adjacent grooves (5) on the cathode plate is 10-30 μm.

16. A cathode plate according to claim 11, characterized in that the cathode plate is a permanent cathode.

* * * * *